United States Patent [19]
Iwasaki
[11] 4,298,169
[45] Nov. 3, 1981

[54] SELECTIVE FLOCCULATION, MAGNETIC SEPARATION, AND FLOTATION OF ORES

[75] Inventor: Iwao Iwasaki, St. Paul, Minn.

[73] Assignee: The Regents of the University of Minnesota, Minneapolis, Minn.

[21] Appl. No.: 79,074

[22] Filed: Sep. 26, 1979

[51] Int. Cl.[3] ..... B02C 23/18
[52] U.S. Cl. ..... 241/16; 209/5; 209/8; 209/39; 209/166; 241/20
[58] Field of Search ..... 209/5, 9, 214, 39, 167, 209/218, 3, 166, 164; 241/20, 21, 24, 16

[56] References Cited

U.S. PATENT DOCUMENTS

| | | | |
|---|---|---|---|
| 861,782 | 7/1907 | Wait | 209/9 X |
| 959,239 | 5/1910 | Lockwood | 209/214 |
| 1,063,893 | 6/1913 | Schwerin | 209/5 X |
| 2,352,324 | 6/1944 | Hubler | 209/39 X |
| 2,388,471 | 11/1945 | DeVaney | 209/39 |
| 3,124,527 | 3/1964 | Watanabe | 209/218 |
| 3,292,780 | 12/1966 | Frommer | 209/5 |
| 3,371,778 | 3/1968 | Iwasaki | 209/166 X |
| 3,502,271 | 3/1970 | Hays | 209/167 X |
| 3,826,365 | 7/1974 | Mercade | 209/214 X |
| 3,926,789 | 12/1975 | Shubert | 209/214 X |
| 3,929,627 | 12/1975 | Fransiskus | 209/9 |
| 4,087,004 | 5/1978 | Nott | 209/214 |
| 4,113,466 | 9/1978 | Weston | 209/39 |
| 4,205,979 | 6/1980 | Kindig | 209/214 X |
| 4,225,425 | 9/1980 | Price | 209/8 |

FOREIGN PATENT DOCUMENTS

| | | | |
|---|---|---|---|
| 235591 | 1/1969 | U.S.S.R. | 209/5 |
| 382428 | 8/1973 | U.S.S.R. | 209/5 |
| 452500 | 4/1975 | U.S.S.R. | 209/5 |
| 498031 | 1/1976 | U.S.S.R. | 209/5 |

OTHER PUBLICATIONS

Taggart, Handbook of Mineral Dressing, 13-19, 1945.

*Primary Examiner*—Robert Halper
*Attorney, Agent, or Firm*—Burd, Bartz & Gutenkauf

[57] ABSTRACT

Low-grade, finely disseminated, ores that are not readily amenable to conventional flotation can be upgraded by a selective flocculation-magnetic separation-flotation process. Non-magnetic particles in such an ore can be selectively flocculated either by iron particles in the ore that contain residual magnetite or by the addition of a finely ground magnetic concentrate to the ore. The selectively flocculated pulp is then passed through a magnetic separator for the rejection of siliceous gangue. Depending on the grade of the magnetic concentrates, either cationic or anionic silica flotation may be applied for further upgrading.

13 Claims, No Drawings

SELECTIVE FLOCCULATION, MAGNETIC SEPARATION, AND FLOTATION OF ORES

FIELD OF THE INVENTION

Background of the Invention

This invention is directed to the beneficiation of low-grade, finely divided, oxidized iron ores that are not readily amenable to conventional flotation. Such ores can be upgraded by selective flocculation followed by magnetic separation and flotation. The invention is directed especially to the beneficiation of low-grade, finely divided, oxidized or partially oxidized iron ores.

The selective flocculation-desliming-flotation process is practiced successfully, for example, at the Tilden mine of the Cleveland Cliffs Iron Company in Upper Michigan. That process, however, is not effective for oxidized iron ores which are lower in grade than those at Tilden. The head analysis at Tilden averages 35 percent iron. The selective flocculation followed by desliming removes fine siliceous gangue but leaves coarse siliceous gangue in the deslimed sand, which then must be removed by flotation. The flotation removal of the remaining coarse quartz tends to make fine iron oxide particles float. When coarse quartz particles are present in large amounts, as in the case of low-grade iron ores, the selectivity of the flotation separation is impaired and the process practiced at the Tilden mine becomes ineffective.

The concentration method of the present invention is not restricted to the processing of iron ores, but it may also be applied to many other ores, such as sulfide ores, oxidized base metal ores, salt-type mineral ores, coal, etc., on which selective flocculation-desliming separations have been achieved. Selective flocculation separations have been achieved with various mineral combinations including galena with quartz and with calcite, alumina with quartz, manganese oxide and carbonate with unspecified gangue, mixed oxide and sulfide copper minerals with dolomite and with quartz and with calcite, chromite with unspecified gangue, coal with shale, and others.

THE PRIOR ART

A process for concentrating oxidized iron ores by selective flocculation and flotation has been described by Frommer and Colombo in U.S. Pat. No. 3,292,780 (1966). Their process comprises the following sequence of steps: (1) initially forming a relatively stable aqueous dispersion of the ore, (2) treating the dispersion of ore with a flocculating agent selected from the group consisting of starches, flours, and polyacrylamides, and capable of causing selective flocculation of the iron oxides in the ore in preference to silica materials, (3) allowing the flocculated iron oxides to settle, (4) separating and removing the suspended silica materials from the flocculated iron oxides, and (5) subsequently subjecting an aqueous pulp of the flocculated iron oxides to a froth flotation operation in the presence of a collector to further separate iron oxides from siliceous materials. This process has been in practice by the Cleveland Cliffs Iron Company at the Tilden mine since 1975.

The use of finely-ground magnetite for the separation of minerals that can be selectively collector-coated, known as the Murex process, has been described by Taggart in his Handbook of Mineral Dressing (1945). The Murex process is a combination of magnetic separation with the differential-oiling phenomenon that is utilized in flotation processes. It is applicable to the separation of any minerals that can be selectively collector-coated. In the Murex process, the oil is first loaded with powdered magnetite, then mixed with the aqueous pulp, and the whole is presented in a thin film under the poles of a magnet, when the oil-coated minerals are attracted to the magnet because of the magnetite in the oily coating, while the non-coated gangue particles pass on.

SUMMARY OF THE INVENTION

Broadly stated, the present invention is directed to a method of concentrating low-grade ores. According to this method, the ore is first mixed with water and ground to a fineness sufficient to substantially liberate the desired minerals from the siliceous or other gangue in the ore. Preferably a dispersant is added to the ore before grinding. The resulting finely ground ore is then mixed with a flocculating agent to induce selective flocculation of the desired mineral particles on nuclei of ore particles containing residual magnetite. If the ore contains little or no residual magnetite, then a small amount of finely ground magnetite concentrate can be added to increase the mineral recovery.

The flocculated ore particles are then subjected to magnetic separation. This is accomplished by flowing a stream of dispersed flocculated ore over a magnetic surface. The gangue is washed from the magnetic surface and discarded. The retained flocs of mineral are recovered and concentrated by removal from the magnetic surface. Where desired, the magnetically separated concentrate may be further concentrated by conventional flotation methods.

DETAILED DESCRIPTION OF THE PREFERRED EMBODIMENT

Although the concentration method of this invention is applicable to other ores which may be separated by selective flocculation, the invention is illustrated by specific reference to iron ores. Thus, low-grade oxidized iron ore averaging less than about 35 percent iron is mixed with water, and preferably with dispersants, and ground in a mill to liberation, that is, to sufficient fineness to substantially free the iron minerals from the siliceous gangue in the ore. The specific dispersants used, their concentration, pH, etc. are not critical and will vary with the particular ore, state of subdivision of the ore, etc. The function of the dispersant is merely to maintain a uniform dispersion of the ore in water and the optimum conditions required can be readily determined by a skilled operator. However, a pH of from about 9.5 to about 11.0 provided by the addition of about 1 to 4 pounds of an alkaline dispersant per ton of ore is generally preferred. Caustic soda, caustic potash, ammonium hydroxide, sodium silicate, and the like, may be used to provide the desired pH. Dispersants such as tannins, lignin sulphonates and alkaline phosphates will also provide a stable relatively non-settling suspension. A preferred dispersant is a mixture of caustic soda and sodium silicate. Water is usually employed in an amount to provide a slurry containing about 50 to 80 percent solids during grinding.

The discharge from the grinding mill is diluted to between about 5 and 40 percent solids, preferably about 10 to 25 percent solids, and mixed with a flocculating agent to induce selective flocculation of iron oxides on nuclei of particles containing residual magnetite. Any flocculating materials that cause a selective flocculation of the iron oxide in preference to the silica materials may be used. Examples of materials used to achieve selective flocculation separations are carbohydrates, such as corn starch, potato starch, other natural and modified starches, tapioca flour, other flours, ammonium alginate, carboxymethyl cellulose, cellulose xanthate, and synthetic polymerized flocculants, such as polyethylene oxide, polyacrylamides and polyacrylonitriles having flocculating properties, PAMG (a polyacrylamide modified with glyoxal tris-2-hydroxyaryl), and the like. A preferred flocculant for separation of iron oxide is a causticized corn starch added at the rate of about 0.25 to 1.0 pound per ton of ore, preferably about 0.5 pound per ton. The suspension of ore and flocculant are agitated briefly. The selectively flocculated ore pulp is then fed to flow over a magnetic surface. The flocs of iron oxides adhere to the magnetic surface and are separated from the non-magnetic siliceous gangue.

If the native ore contains little residual magnetite, a small amount, from about 2 to 10 percent by weight, of finely divided ground magnetite concentrate can be added to increase the iron recovery. While greater amounts of magnetite may be added to the ore, the addition of more than the optimal amount, dependent upon the composition of the particular ore, merely adds to the cost without producing corresponding benefits. The added magnetite is uniformly dispersed through the ore before selective flocculation. The magnetic concentrate retained on the magnetic surface is removed by scraping or by the use of a magnet, or the like. Where desired, the magnetic concentrate may be transferred to a flotation cell, and upgraded by flotation methods conventional in the beneficiation of iron ores. A magnetic separating machine such as that illustrated and described in U.S. Pat. No. 3,124,527, issued to Watanabe et al (1964), is exemplary of one apparatus which may be used in carrying out the magnetic separation step.

The invention is further illustrated by the following:

EXAMPLE 1

An oxidized iron ore with a typical head analysis of 27.0 percent iron and 46.3 percent silica was used in this series of tests.

(A) A sample was ground in a stainless steel laboratory rod mill at 50 percent solids to 75 percent minus 500 mesh and a portion of the ground sample was used in a Davis magnetic tube (DMT) test to ascertain the magnetic iron content. The results are given in Table 1.

TABLE 1

DAVIS MAGNETIC TUBE TEST RESULTS

| | % Wt. | % Fe | Fe Distn |
|---|---|---|---|
| DMT Conc. | 20.90 | 70.50 | 54.39 |
| DMT Tail | 79.10 | 15.62 | 45.61 |
| Composite | 100.00 | 27.10 | 100.00 |

(B) A sample was ground in a stainless steel laboratory rod mill together with 1.5 pounds of caustic soda and one pound of sodium silicate per ton at 50 percent solids to 70 percent minus 500 mesh. The ground ore sample was transferred to an 8-liter plastic container. Sufficient water was added to the 6-liter mark and agitated with a Fagergren flotation impeller mechanism. After 0.5 pound of causticized starch per ton had been added, the suspension was agitated for a half minute and allowed to settle for 2 minutes. After the pulp had settled, the supernatant liquid was siphoned off and water was added up to the 6-liter mark. Then the suspension was agitated for 10 seconds and allowed to settle for 2 minutes before the supernatant liquid was again siphoned. Three deslimings were thus made. All three slimes were combined, weighed and analyzed.

To the deslimed pulp, water was added to volume and the pH was adjusted to 10 using caustic soda, 0.5 pound of dextrin per ton was added as a depressant for iron and conditioned for one minute, followed by another one-minute conditioning with 0.1 pound of Arosurf MG-98A per ton. Then the air was turned on and the rougher froth was collected for 2 minutes. The rougher cell product was cleaned three times with further addition of the amine collector of 0.075 pound per ton. The cleaner froths were combined with the rougher froth and scavenged for 2 minutes. The make-up water was pre-adjusted to pH 10 and thereby the pulp pH was maintained at 10 throughout the flotation tests. The results are given in Table 2.

TABLE 2

SELECTIVE DESLIMING FOLLOWED BY CATIONIC FLOTATION OF SILICA

| | | | | Cumulative | | |
|---|---|---|---|---|---|---|
| Products | % Wt | % Fe | Fe Rec | % Wt | % Fe | Fe Rec |
| Slimes | 26.18 | 10.47 | 9.61 | 100.00 | 28.49 | 100.00 |
| Sc Froth 2 | 34.74 | 10.30 | 12.57 | 73.82 | 34.88 | 90.39 |
| Sc Cl 1 Froth | 4.55 | 42.67 | 6.81 | 39.08 | 56.73 | 77.82 |
| Sc Cl 2 Froth | 1.92 | 46.13 | 3.12 | 34.53 | 58.59 | 71.01 |
| Sc Cl 2 Cp | 10.76 | 52.25 | 19.73 | 32.61 | 59.31 | 67.89 |
| Cell Prod | 21.85 | 62.79 | 48.16 | 21.85 | 62.79 | 48.16 |

(C) A sample was ground with 1.5 pounds of caustic soda and 2 pounds of sodium silicate per ton to 70 percent passing 500 mesh. The ground ore was then transferred to an 8-liter plastic container. Sufficient water was added to the 6-liter mark and agitated with a Fagergren flotation impeller mechanism. After 0.5 pound of causticized starch per ton had been added, the suspension was agitated for a half minute and the conditioned pulp was fed to an inclined trough of magnetic sheet. The flocs of iron oxides were retained on the trough, whereas the siliceous gangue particles were washed down the trough by the flowing water and collected in a bucket. The non-magnetic tailing was filtered, dried, weighed, and analyzed. The flocs of iron oxides on the trough were removed with a rubber scraper and placed in a flotation cell. Water was added to volume and the pH was adjusted to 10 using caustic soda. One pound of dextrin per ton was added and conditioned for one minute, followed by another one-minute conditioning with 0.1 pound of amine collector, Arosurf MG-98A, per ton. Then the air was turned on and the rougher froth was collected for 2 minutes. The rougher cell product was cleaned in two stages with further addition of the amine collector in the amounts of 0.1 and 0.05 pound per ton. The cleaner froths were combined with the rougher froth, conditioned with one pound of dextrin per ton, and scavenged for two minutes in two stages. The make-up water was pre-adjusted to pH 10 and thereby the pulp pH was maintained at 10 throughout the flotation tests. The results of one such test are given in Table 3.

TABLE 3

RESULTS BY THE PRESENT INVENTION

| Product | | | Cumulative % Wt | Cumulative % Fe | Cumulative Fe Rec |
|---|---|---|---|---|---|
| Nonmag Tail | 52.29 | 7.73 | 100.00 | 27.10 | 100.00 |
| Scav 2 Froth | 12.97 | 13.28 | 47.71 | 48.33 | 85.09 |
| Scav 2 Conc | 4.57 | 42.50 | 34.74 | 61.43 | 78.74 |
| Scav 1 Conc | 8.69 | 59.81 | 30.17 | 64.30 | 71.58 |
| Cl 2 Conc | 21.48 | 66.09 | 21.48 | 66.09 | 52.40 |

EXAMPLE 2

An oxidized iron ore analyzing 44.2 percent iron and 27.42 percent silica was used in this series of tests.

(A) A sample was ground in a stainless steel laboratory rod mill at 50 percent solids to 85 percent minus 500 mesh and a portion of the ground sample was used in a Davis magnetic tube (DMT) test to ascertain the magnetic iron content. The results are given in Table 4.

TABLE 4

DAVIS MAGNETIC TUBE TEST RESULTS

| | % Wt | % Fe | Fe Distn |
|---|---|---|---|
| DMT Conc | 1.13 | 69.32 | 1.80 |
| DMT Tail | 98.87 | 43.02 | 98.20 |
| Composite | 100.00 | 43.31 | 100.00 |

(B) A sample was ground with 1.7 pounds of caustic soda and 2 pounds of sodium silicate per ton to 85 percent minus 500 mesh. The ground ore sample was transferred to an 8-liter plastic container. Sufficient water was added to the 6-liter mark and agitated with a Fagergren flotation impeller mechanism. After 0.35 pound of causticized starch per ton had been added, the suspension was agitated for a half minute and allowed to settle for 2 minutes. After the pulp had settled, the supernatant liquid was siphoned off and water was added to the 6-liter mark. Then the suspension was agitated for 10 seconds and allowed to settle for 2 minutes before the supernatant liquid was again siphoned. The two slime products were combined, weighed, and analyzed.

To the deslimed pulp, water was added to volume and the pH was adjusted to 10 using caustic soda, one pound of dextrin per ton was added as a depressant for iron and conditioned for one minute, followed by another one-minute conditioning with 0.1 pound of Arosurf MG-98A per ton. Then the air was turned on and the rougher froth was collected for 2 minutes. The rougher cell product was cleaned with further addition of 0.1 pound per ton of the amine collector. The cleaner froth was combined with the rougher froth and scavenged three times for two minutes each. The make-up water was pre-adjusted to pH 10 and thereby the pulp pH was maintained at 10 throughout the flotation tests. The results are given in Table 5.

TABLE 5

SELECTIVE DESLIMING FOLLOWED BY CATIONIC FLOTATION OF SILICA

| Products | % Wt | % Fe | Fe Rec | Cumulative % Wt | Cumulative % Fe | Cumulative Fe Rec |
|---|---|---|---|---|---|---|
| Slimes | 27.96 | 23.47 | 14.98 | 100.00 | 43.78 | 100.00 |
| Sc 3 Froth | 16.51 | 10.30 | 3.88 | 72.04 | 51.67 | 85.02 |
| Sc 3 Conc | 2.53 | 47.66 | 2.76 | 55.53 | 63.97 | 81.14 |
| Sc 2 Conc | 5.01 | 58.93 | 6.74 | 53.00 | 64.74 | 78.38 |
| Sc 1 Conc | 13.93 | 63.35 | 20.15 | 47.99 | 65.35 | 71.64 |

TABLE 5-continued

SELECTIVE DESLIMING FOLLOWED BY CATIONIC FLOTATION OF SILICA

| Products | % Wt | % Fe | Fe Rec | Cumulative % Wt | Cumulative % Fe | Cumulative Fe Rec |
|---|---|---|---|---|---|---|
| Final Conc | 34.06 | 66.17 | 51.49 | 34.06 | 66.17 | 51.49 |

(C) A sample was ground with 1.5 pounds of caustic soda and one pound of sodium silicate per ton to 85 percent passing 500 mesh. The ground ore was then transferred to an 8-liter plastic container. Sufficient water was added to the 6-liter mark and agitated with a Fagergren flotation impeller mechanism. After 0.5 pound of causticized starch per ton had been added, the suspension was agitated for a half minute and the conditioned pulp was fed to an inclined trough of magnetic sheet. The flocs of iron oxides were retained on the trough, whereas the siliceous gangue particles were washed down the trough by the flowing water and collected in a bucket. The non-magnetic tailing was filtered, dried, weighed, and analyzed. The flocs of iron oxides on the trough were removed with a rubber scraper and placed in a flotation cell. Water was added to volume and the pH was adjusted to 10 using caustic soda. One pound of dextrin per ton was added and conditioned for one minute, followed by another one-minute conditioning with 0.1 pound of an amine collector, Arosurf MG-98A3, per ton. Then the air was turned on and the rougher froth was collected for two minutes. The rougher cell product was cleaned in two stages with further addition of the amine collector in the amounts of 0.1 and 0.05 pound per ton. The cleaner froths were combined with the rougher froth, conditioned with one pound of dextrin per ton, and scavenged for 2 minutes in three stages. The make-up water was pre-adjusted to pH 10 and thereby the pulp pH was maintained at 10 throughout the flotation tests. The results of one such test are given in Table 6.

TABLE 6

RESULTS BY THE PRESENT INVENTION

| Product | % Wt | % Fe | Cumulative % Wt | Cumulative % Fe | Cumulative Fe Rec |
|---|---|---|---|---|---|
| Nonmag Tail | 13.00 | 7.97 | 100.00 | 44.42 | 100.00 |
| Scav 3 Froth | 31.41 | 20.93 | 87.00 | 49.87 | 97.67 |
| Scav 3 Conc | 6.82 | 63.60 | 55.59 | 66.22 | 82.87 |
| Scav 2 Conc | 4.44 | 66.25 | 48.77 | 66.58 | 73.10 |
| Scav 1 Conc | 14.70 | 66.09 | 44.33 | 66.62 | 66.48 |
| Cl 2 Conc | 29.63 | 66.90 | 29.63 | 66.90 | 44.61 |

EXAMPLES 3-15

The effectiveness of the present invention hinges on the presence of magnetite in iron ores to be upgraded. If an ore contains very little magnetite, an addition of finely ground magnetite becomes necessary. An iron ore sample analyzing 34.15 percent iron was used for this series of tests.

(A) A sample was ground in a stainless steel laboratory rod mill at 50 percent solids to 85 percent minus 500 mesh and a portion of the ground sample was used in a Davis magnetic tube (DMT) test to ascertain the magnetic iron content. The results are given in Table 7.

TABLE 7

| DAVIS MAGNETIC TUBE TEST | | | |
|---|---|---|---|
| | % Wt | % Fe | Fe Distn |
| DMT Conc | 0.75 | 70.50 | 1.57 |
| DMT Tail | 99.25 | 33.17 | 98.43 |
| Composite | 100.00 | 44.39 | 100.00 |

(B) To ascertain how much magnetite is required to recover non-magnetic iron oxides, the ore was ground to 85 percent minus 500 mesh together with 1.5 pounds of caustic soda and one pound of sodium silicate. The ground ore was mixed with various proportions of a magnetite concentrate having a size consist of 85 percent minus 500 mesh and analyzing 70.11 percent iron, selectively flocculated with causticized starch and upgraded on the magnetic trough. The results are summarized in Table 8. As is seen in the table, the presence of magnetite in the amount of about 5 to 8 percent of the non-magnetic iron oxides, or 2.5 to 4 percent by weight of the sample, is sufficient for full recovery of the iron units.

TABLE 8

| THE EFFECT OF THE LEVEL OF MAGNETITE ADDITION ON THE PRECONCENTRATION | | | | | |
|---|---|---|---|---|---|
| Magnetite Addition | | | Non-magnetic Tailing | | |
| Example | % Wt | % of Hematite | % Wt | % Fe | Fe Distn |
| Corn Starch Addition: 0.5 lb per ton | | | | | |
| 3 | 0 | 0 | 62.22 | 24.62 | 45.43 |
| 4 | 1.25 | 2.5 | 33.39 | 16.47 | 15.81 |
| 5 | 2.5 | 5 | 31.79 | 11.52 | 10.45 |
| 6 | 4 | 8 | 30.89 | 8.19 | 7.12 |
| 7 | 5 | 10 | 29.06 | 6.57 | 5.31 |
| 8 | 6 | 12 | 28.33 | 7.79 | 6.07 |
| 9 | 10 | 20 | 27.64 | 5.84 | 4.35 |
| 10 | 15 | 30 | 27.85 | 6.00 | 4.32 |
| 11 | 25 | 50 | 28.31 | 6.16 | 4.18 |
| Corn Starch Addition: 0.3 lb per ton | | | | | |
| 12 | 2.5 | 5 | 30.09 | 8.44 | 7.35 |
| 13 | 4 | 8 | 29.60 | 7.63 | 6.31 |
| 14 | 5 | 10 | 28.70 | 7.54 | 5.86 |
| 15 | 6 | 12 | 28.32 | 8.03 | 5.85 |

The added magnetite may be recovered for reuse. This can be achieved readily with a conventional magnetic separator with a strong flow of wash water. The selective desliming of this sample rejected the slime product amounting to 17.58 percent by weight, analyzing 14.57 percent iron, again showing the effectiveness of the selective flocculation-magnetic separation method.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A method of concentrating low-grade ores containing residual magnetite, which method comprises:

(A) mixing said ore with water and grinding to a fineness sufficient to substantially liberate the desired mineral values in said ore, (B) mixing said finely divided ore, containing magnetite, with a flocculating material selected from the class consisting of carbohydrate and synthetic polymerized flocculating agents to induce selective flocculation of the desired mineral on nuclei of ore particles containing residual magnetite, (C) subjecting said flocculated mineral to magnetic separation, (D) recovering the flocs of mineral, and (E) discarding the non-magnetic gangue.

2. A method according to claim 1 wherein the resulting magnetically separated concentrate is further concentrated by flotation of silica.

3. A method according to claim 1 wherein the ore initially contains little or no residual magnetite and finely ground magnetite concentrate is added to the ore before flocculation.

4. A method according to claim 1 wherein a dispersant is added to the ore before grinding.

5. A method according to claim 4 wherein said ore is oxidized or partially oxidized iron ore and said dispersant is selected from the group consisting of caustic soda and sodium silicate and mixtures thereof.

6. A method according to claim 1 wherein said ore is oxidized or partially oxidized iron ore and said flocculating material is starch.

7. A method according to claim 6 wherein said starch is causticized corn starch.

8. A method according to claim 1 wherein:

(A) said desired mineral is recovered by flowing a stream of dispersed flocculated ore over a magnetic surface, (B) the gangue is washed from the surface, and (C) the retained flocs of desired mineral are concentrated by removal from the magnetic surface.

9. A method according to claim 8 wherein said magnetic surface is inclined to facilitate washing of gangue from the surface.

10. A method of concentrating low-grade oxidized and partially oxidized iron ores containing residual magnetite, which method comprises:

(A) mixing said ore with a dispersant selected from the group consisting of caustic soda and sodium silicate and mixtures thereof, and water, and grinding to a fineness sufficient to substantially liberate the iron values in said ore, (B) mixing said finely divided ore containing magnetite with a causticized starch flocculating material to induce selective flocculation of iron oxides on nuclei of ore particles containing residual magnetite, (C) flowing a stream of selectively flocculated ore over an inclined magnetic surface, (D) washing the siliceous gangue from the magnetic surface, and (E) recovering the retained flocs of iron oxide by removal from the magnetic surface.

11. A method according to claim 10 wherein the resulting magnetically separated iron oxide concentrate is further concentrated by flotation.

12. A method according to claim 10 wherein the ore initially contains little or no residual magnetite and finely ground magnetite concentrate is added to the ore before flocculation.

13. A method of concentrating low-grade oxidized and partially oxidized iron ores containing residual magnetite, which method comprises:

(A) mixing said ore with about 1 to 4 pounds of an alkaline dispersant per ton of ore and water to provide a slurry containing about 50 to 80 percent solids and having a pH of from about 9.5 to about 11.0, (B) grinding said slurry to a fineness sufficient to substantially liberate the iron values in said ore, (C) diluting the finely divided ground material to between about 5 and 40 percent solids, (D) mixing said diluted slurry of finely divided ore containing magnetite with about 0.25 to 1.0 pound per ton of ore of a flocculating material to induce selective flocculation of iron oxides on nuclei of ore particles containing residual magnetite, (E) flowing a stream of selectively flocculated ore over an inclined magnetic surface to trap the ore particles containing residual magnetite thereon, (F) washing the siliceous gangue from the magnetic surface, and (G) recovering the retained flocs of iron oxide by removal from the magnetic surface.

* * * * *